US012005369B2

(12) United States Patent
Marino et al.

(10) Patent No.: US 12,005,369 B2
(45) Date of Patent: Jun. 11, 2024

(54) RC VEHICLE WITH CONVERTIBLE WHEEL HAVING EXPANDABLE AND RETRACTABLE BLADES

(71) Applicant: Jakks Pacific Inc., Santa Monica, CA (US)

(72) Inventors: Robert J. Marino, Altadena, CA (US); Scott Hart Derman, Sherman Oaks, CA (US); Erich William Weidetz, Sherman Oaks, CA (US); Min Jin Kim, Los Angeles, CA (US); Zack Bieber, Wellington, CO (US)

(73) Assignee: JAKKS PACIFIC INC., Santa Monica, CA (US)

( * ) Notice: Subject to any disclaimer, the term of this patent is extended or adjusted under 35 U.S.C. 154(b) by 4 days.

(21) Appl. No.: 17/550,800

(22) Filed: Dec. 14, 2021

(65) Prior Publication Data

US 2022/0184513 A1 Jun. 16, 2022

Related U.S. Application Data

(60) Provisional application No. 63/125,330, filed on Dec. 14, 2020.

(51) Int. Cl.

| | |
|---|---|
| ***A63H 17/18*** | (2006.01) |
| ***A63H 17/00*** | (2006.01) |
| ***A63H 17/26*** | (2006.01) |

(52) U.S. Cl.

CPC ..... *A63H 17/18* (2013.01); *A63H 17/004* (2013.01); *A63H 17/266* (2013.01)

(58) Field of Classification Search

CPC .... A63H 17/004; A63H 17/18; A63H 17/262; A63H 17/266

See application file for complete search history.

(56) References Cited

U.S. PATENT DOCUMENTS

| | | | | |
|---|---|---|---|---|
| 4,547,173 A * | 10/1985 | Jaworski | ..... | A63H 17/262 446/457 |
| 4,601,519 A * | 7/1986 | D'Andrade | ..... | A63H 17/262 301/41.1 |
| 4,643,696 A * | 2/1987 | Law | ..... | A63H 17/262 301/45 |

(Continued)

FOREIGN PATENT DOCUMENTS

| | | |
|---|---|---|
| CN | 102350917 A | 2/2012 |
| JP | 2010-155520 A | 7/2010 |
| KR | 10-1384826 B1 | 4/2014 |

OTHER PUBLICATIONS

Notification of Transmittal and The International Search Report, and the Written Opinion of the International Searching Authority for PCT/US2021/063401 (JPI1023-PCT); dated Mar. 28, 2022.

(Continued)

*Primary Examiner* — Eugene L Kim
*Assistant Examiner* — Alyssa M Hylinski
(74) *Attorney, Agent, or Firm* — TOPE-MCKAY & ASSOCIATES

(57) ABSTRACT

Described is a remote control (RC) vehicle having a convertible wheel (e.g., front wheel) with a plurality of blades. The blades are controlled with a controller to cause the blades to transition between retracted and expanded states to create a buzz saw-looking wheel for multi-terrain applications.

5 Claims, 10 Drawing Sheets

(56) References Cited

U.S. PATENT DOCUMENTS

| | | | | |
|---|---|---|---|---|
| 4,648,853 | A * | 3/1987 | Siegfried | A63H 17/262 446/457 |
| 5,487,692 | A | 1/1996 | Mowrer et al. | |
| 6,939,197 | B1 * | 9/2005 | Hoeting | A63H 17/004 446/454 |
| 7,217,170 | B2 | 5/2007 | Moll et al. | |
| 7,794,300 | B2 | 9/2010 | Moll et al. | |
| 8,007,341 | B2 * | 8/2011 | Su | A63H 17/262 446/431 |
| 8,197,298 | B2 | 6/2012 | Willett | |
| 8,430,713 | B2 * | 4/2013 | Willett | A63H 17/18 446/470 |
| 9,073,587 | B2 * | 7/2015 | Kim | B62D 57/028 |
| 10,518,576 | B1 * | 12/2019 | Ebrahimi Afrouzi | B60B 19/003 |
| 10,549,576 | B2 | 2/2020 | Hurd | |
| 11,884,102 | B2 * | 1/2024 | Boyer | B60B 19/04 |
| 2002/0137428 | A1 * | 9/2002 | Tilbor | A63H 17/262 446/465 |
| 2003/0082990 | A1 * | 5/2003 | Lynders | A63H 17/18 446/437 |
| 2009/0098799 | A1 * | 4/2009 | Leonov | A63H 17/18 446/460 |
| 2011/0021112 | A1 | 1/2011 | Suzuki | |
| 2012/0319457 | A1 | 12/2012 | Jo | |
| 2014/0227941 | A1 * | 8/2014 | Suzuki | A63H 17/36 446/456 |

OTHER PUBLICATIONS

The International Search Report of the International Searching Authority for PCT/US2021/063401 (JPI1023-PCT); dated Mar. 28, 2022.

The Written Opinion of the International Searching Authority for PCT/US2021/063401 (JPI1023-PCT); dated Mar. 28, 2022.

* cited by examiner

RC VEHICLE WITH CONVERTIBLE WHEEL HAVING EXPANDABLE AND RETRACTABLE BLADES

CROSS-REFERENCE TO RELATED APPLICATIONS

This is a non-provisional application of U.S. Provisional Application No. 63/125,330, filed on Dec. 14, 2020, the entirety of which is incorporated herein by reference.

BACKGROUND OF THE INVENTION

(1) Field of Invention

The present invention relates to a toy car and, more particularly, to a remote-control vehicle having a convertible wheel made of retractable blades that expand and contract for multi-terrain applications.

(2) Description of Related Art

Toy remote control vehicles have long been known in the art and typically four wheels. The wheels of traditional remote-control vehicles operate well on smoothly paved roads and, in some cases, in off-road settings. For instance, smooth wheels work well on paved roads while knobby or off-road tires work well in dirt and on other loose surfaces. However, nothing heretofore devised includes a convertible wheel that can change for varying road conditions and appearances.

Thus, a continuing need exists for a new and improved toy car with a convertible wheel.

SUMMARY OF INVENTION

The present invention relates to a toy car, and more particularly to a remote control (RC) vehicle having a convertible wheel (e.g., front wheel) made of six retractable blades that expand and contract to create a buzz saw-looking wheel for multi-terrain applications.

In one aspect, the RC vehicle includes a housing component having at least one arm extending therefrom and a pair of turning wheels operably connected thereto, the pair of turning wheels being operable for turning between left and right positions. A convertible wheel is rotatably connected to the at least one arm. The convertible wheel having a plurality of expandable and retractable blades movably attached within the convertible wheel. Further, the convertible wheel is operable for driving the RC vehicle in a forward and reverse direction and causing the plurality of blades to selectively transition between a retracted state and an expanded state.

In another aspect, the convertible wheel includes a first motor housed within the convertible wheel, the first motor being operably connected with the plurality of blades to cause the blades to transition between the retracted and expanded states.

In another aspect, first and second wheel covers are positioned within the convertible wheel, and the plurality of blades are pivotally connected to the first and second wheel covers.

In yet another aspect, left and right blade slot components are housed within the convertible wheel and are operably connected between the first motor and the plurality of blades such that operation of the first motor causes the left and right blade slot components to rotate and force the plurality of blades between the retracted and expanded states.

Further, each of the left and right blade slot components have slots formed therethrough, and wherein each of the plurality of blades have a pin projecting therefrom, such that each pin passes through a slot of a corresponding left or right blade slot component, whereby rotation of the left and right blade slot components causes the pin to slide within the corresponding slot to rotate the plurality of blades between the retracted and expanded states.

Additionally, a second motor is operably connected with the convertible wheel to drive the convertible wheel in a forward or reverse direction.

Further, a third motor is positioned with the housing component and operably connected with the left and right wheels to cause the left and right wheels to turn between the left and right positions.

Finally, as can be appreciated by one in the art, the present invention also comprises a method for forming and using the RC vehicle described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a toy car and, more particularly, to a remote control vehicle having a convertible wheel (e.g., front wheel) made of a plurality of retractable blades that expand and contract to create a buzz saw-looking wheel for multi-terrain applications. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
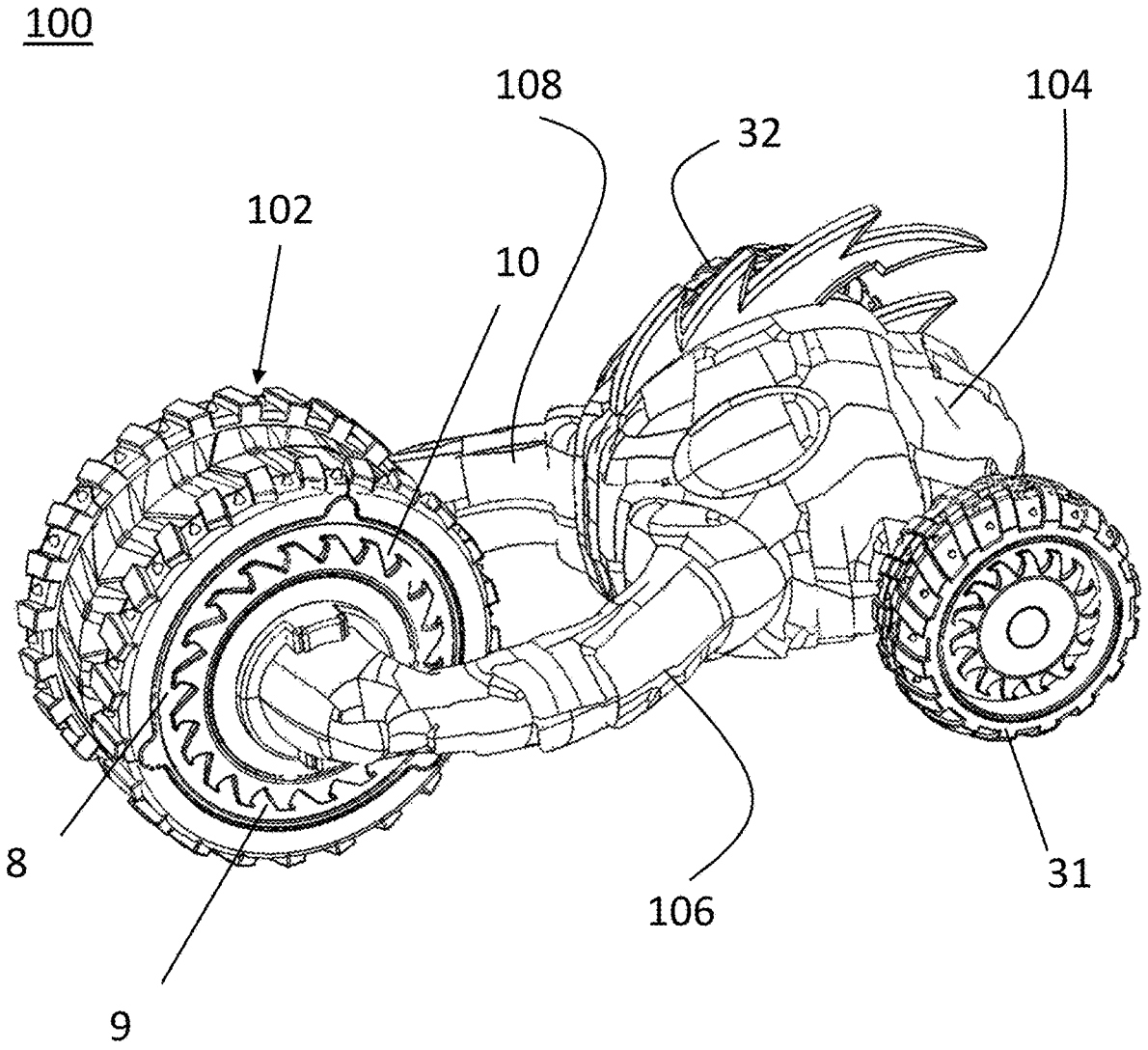
FIG. 1 is an illustration of a remote-control (RC) vehicle with a convertible wheel having expandable and retractable blades according to various embodiments of the present invention, depicting the vehicle with the blades in a retracted state.
Figure 2:
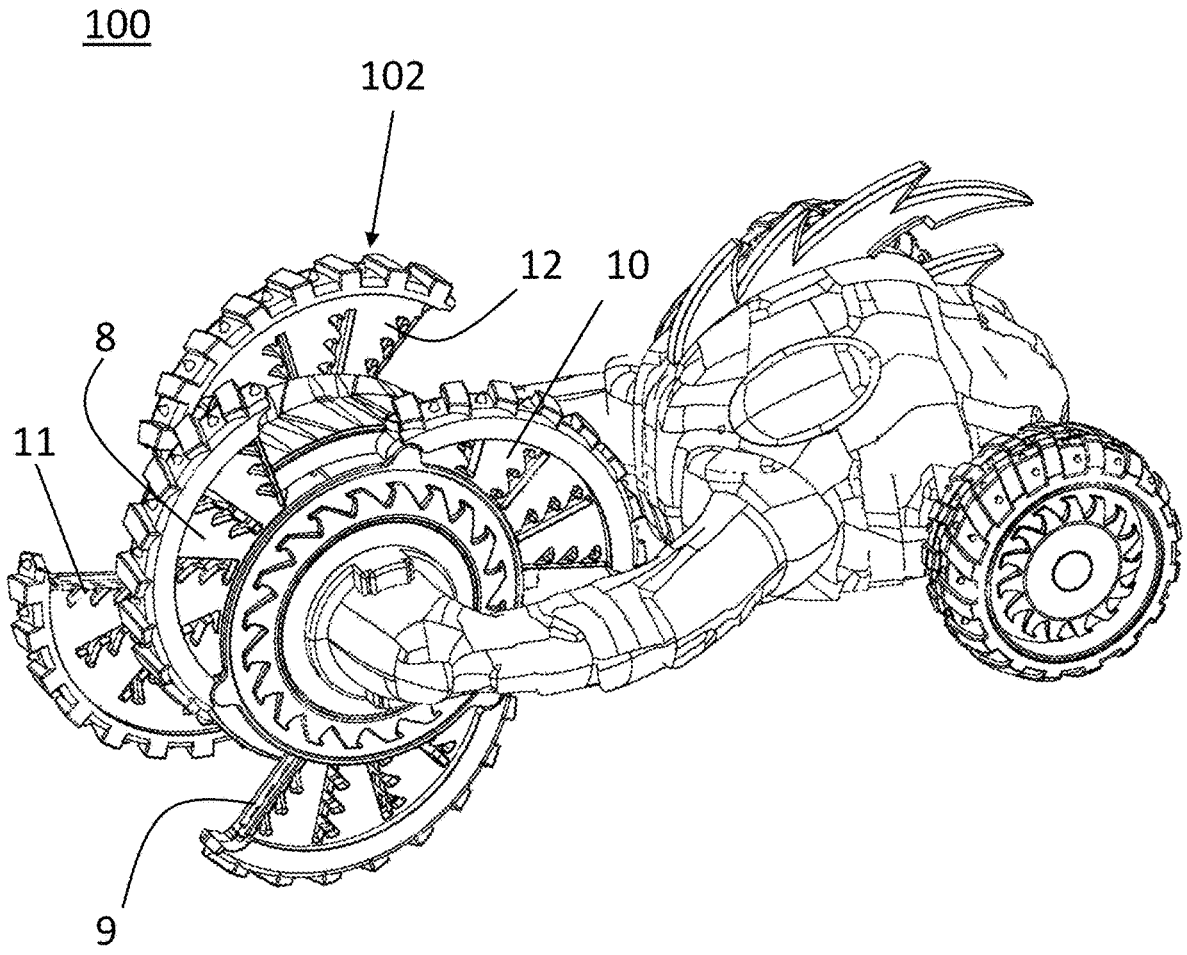
FIG. 2 an illustration of the RC vehicle, depicting the vehicle with the blades in an expanded state.

As noted above and as illustrated between FIGS. 1 and 2, the present disclosure is directed to a remote control (RC) vehicle 100 having at least one convertible wheel 102 made of a plurality of expandable and retractable blades that expand and contract to create a buzzsaw-looking wheel for multi-terrain applications. Specifically, FIG. 1 depicts the RC vehicle 100 with the convertible wheel 102 and its blades (elements 8-10) in the contracted state, while FIG. 2 depicts the RC vehicle 100 with the convertible wheel 102 and blades (elements 8-12) in the expanded state. Thus, the RC vehicle 100 includes any components as may be necessary to allow a user to remotely and selectively convert the convertible wheel 102 between the expanded and contracted state and drive the RC vehicle 100 upon various terrain. Non-limiting examples of a specific embodiment are provided below.

As shown in FIG. 1, the RC vehicle 100 includes a housing component 104. The housing component 104 includes any components as may be necessary to control the RC vehicle 100. For example, the housing component 104 can be formed to include a battery or power source, an integrated circuit and controller (including the receiver, etc. as may be necessary), and any motors as required to operate the RC vehicle 100. Further, left and right wheels 31 and 32 can be included to project from the housing component 104 to provide for turning control. Thus, in one aspect, the left and right wheels 31 and 32 can be selectively turned (left and right) to allow the RC vehicle 100 to turn as it is operated. Thus, in some aspects, the RC vehicle 100 includes a total of three motors. All functions of the RC vehicle 100 are controlled by these three motors, with no servos (although servos can be used for turning or other functions as understood by those skilled in the art).

Figure 8:
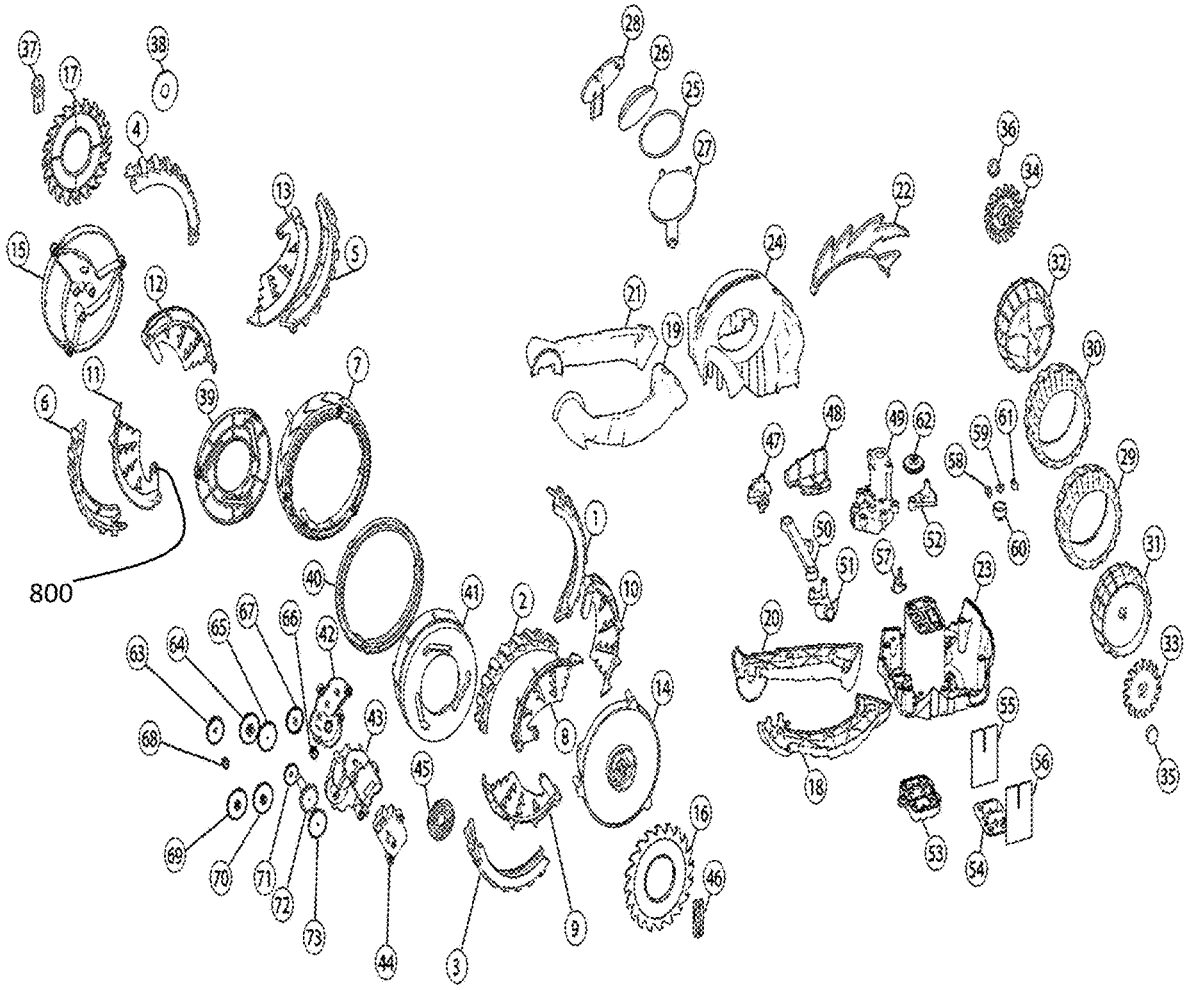
FIG. 8 is an exploded-view illustration of the RC vehicle.

In this aspect and referring to FIG. 8, the first motor is housed within (or otherwise connected to) the first gear box 42 and located in the front convertible wheel 102. It controls the plurality of blades to open and close altogether. The second motor 44 is also located in the front convertible wheel. The second motor 44 engages with a second gear box 43 and controls the rotational motion of the wheel, causing the RC vehicle 100 to forward and backward. Finally, the third motor is located within a third gear box 49 housed within the housing component 104. This third motor controls the steering function to turn left and right via a linkage to turn the rear wheels (elements 31 and 32). Specific details with respect to expandable and retractable blades and the turning mechanism are provided further below.

As shown in FIG. 1, projecting from the housing component 104 are one or more arms (e.g., left arm 106 and right arm 108). The arms 106 and 108 stabilize and hold the convertible wheel 102. Notably and in a desired embodiment, the convertible wheel 102 is a powered drive wheel activated to drive the RC vehicle 100. Thus, the convertible wheel 102 includes all of the necessary components as may be necessary to convert between the expanded contracted states and drive the RC vehicle 100 forward and reverse.

Figure 3A:
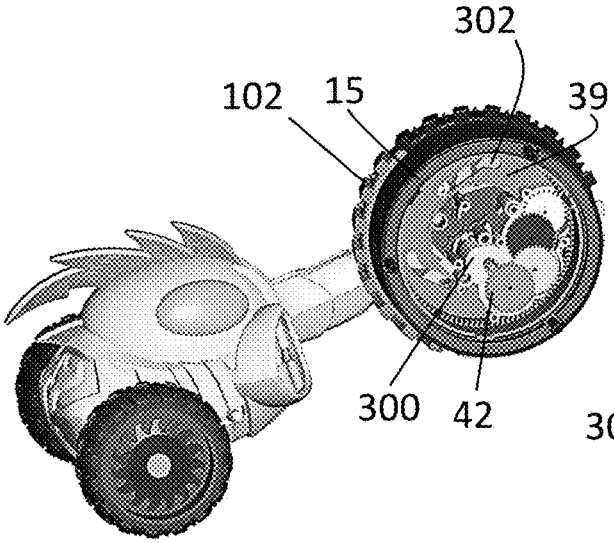
FIG. 3A is an illustration of the RC vehicle, depicting an interior view of a convertible wheel.
Figure 3B:
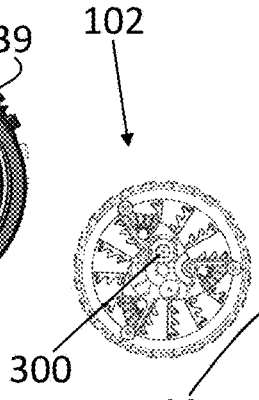
FIG. 3B is an interior-view of the convertible wheel in the contracted state, depicted from a left-side of the vehicle.

For example, in one aspect and as described and illustrated, there is a first motor (housed in the first gear box) within in the convertible wheel 102 that is connected to the blades via a mechanical linkage, such that when the vehicle 102 receives the signal from the remote, it turns the motor in one direction to drive the linkage assembly, pushing the blades out. Alternatively, the motor can be activated in a reverse direction to cause the linkage assembly to draw the blades back in, into the retracted state. For further understanding, FIGS. 3A through 3B illustrate an interior view of the convertible wheel 102 in both the contracted and expanded states. As shown in FIGS. 3A through 3B, the convertible wheel 102 includes a remotely controllable first motor 300 (within the first gear box 42) that is operably connected with a first gear box 42 and its plurality of gears. The first motor 300 and first gear box 42 are operably connected with the linkage components (e.g., right blade slot component 39 and left blade slot component 41) to cause the linkage components to rotate. Each of the slot components 39 (and 41 with respect to the left side) is formed with angled slots 302 therethrough. Separately, each of the blades (elements 8 through 13) are pivotally connected to the wheel covers 14 and 15. Projecting inward from each of the blades 8 through 13 is a small pin (depicted as element 800 in FIG. 8). The pin resides within the slots 302 of the slot component 39. As the gears of the gear box 42 rotates the slot component 39, the pins are forced outward due to the angled shape of the slots 302. Forcing the pins outward causes the blades 8 through 13 to rotate due to their pivotal connection with the wheel covers 14 and 15, thereby causing the pins to transition from the retracted to expanded states. Reversing the rotation of the motor 300 causes the slot component to rotate in the alternate direction and draw the blades 8 through 13 back into the retracted state due to the pins being drawn back in through rotation of the angled slots 302. As can be appreciated by those skilled in the art, the each of the slot components 39 and 41 are connected with one another to similarly rotate upon engagement of the first motor (and first gear box 42) to cause the blades to convert between the expanded and retracted states.

Figure 4:
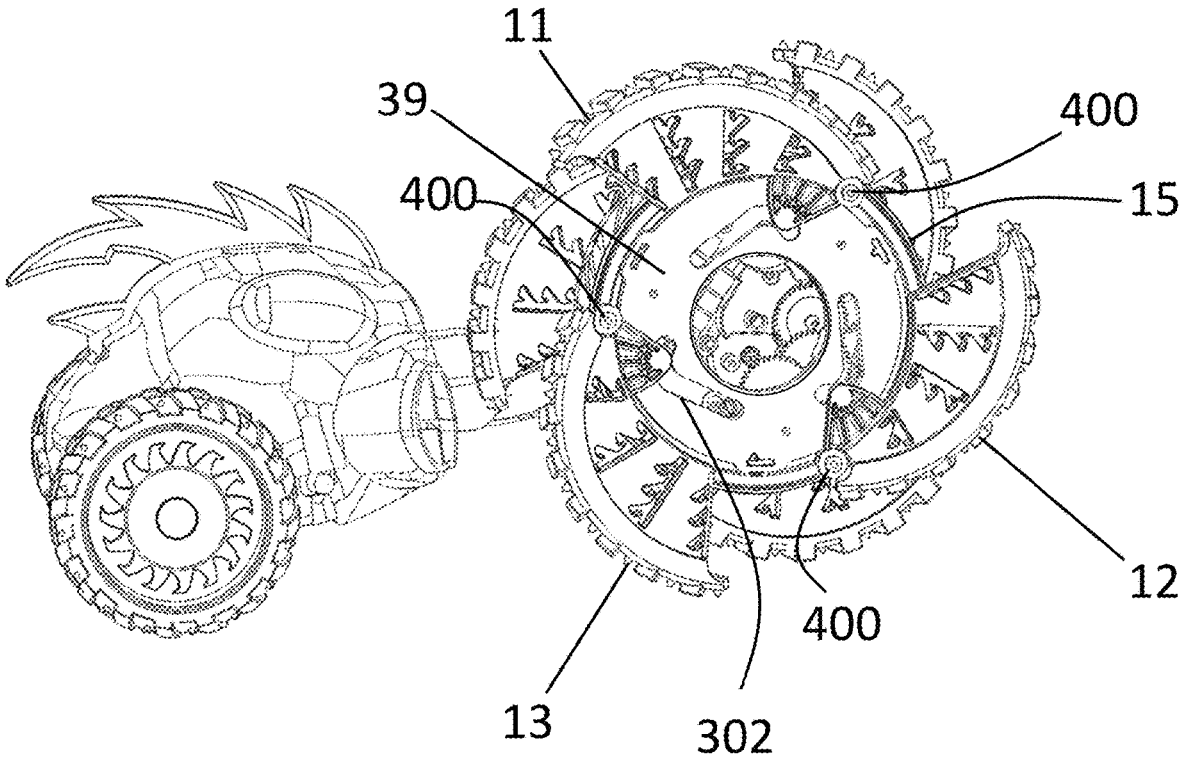
FIG. 4 is an illustration of the RC vehicle, depicting an interior view of a convertible wheel with the wheel in the expanded state.

For further understanding, FIG. 4 provides a right-side, interior-view of the convertible wheel 102. As shown, the blades 11, 12, and 13 are pivotally connected 400 with the wheel cover 15. Also as shown are the slots 302 of the right blade slot component 39 through which the pins of the right blades 11, 12, and 13 reside.

Figure 5:
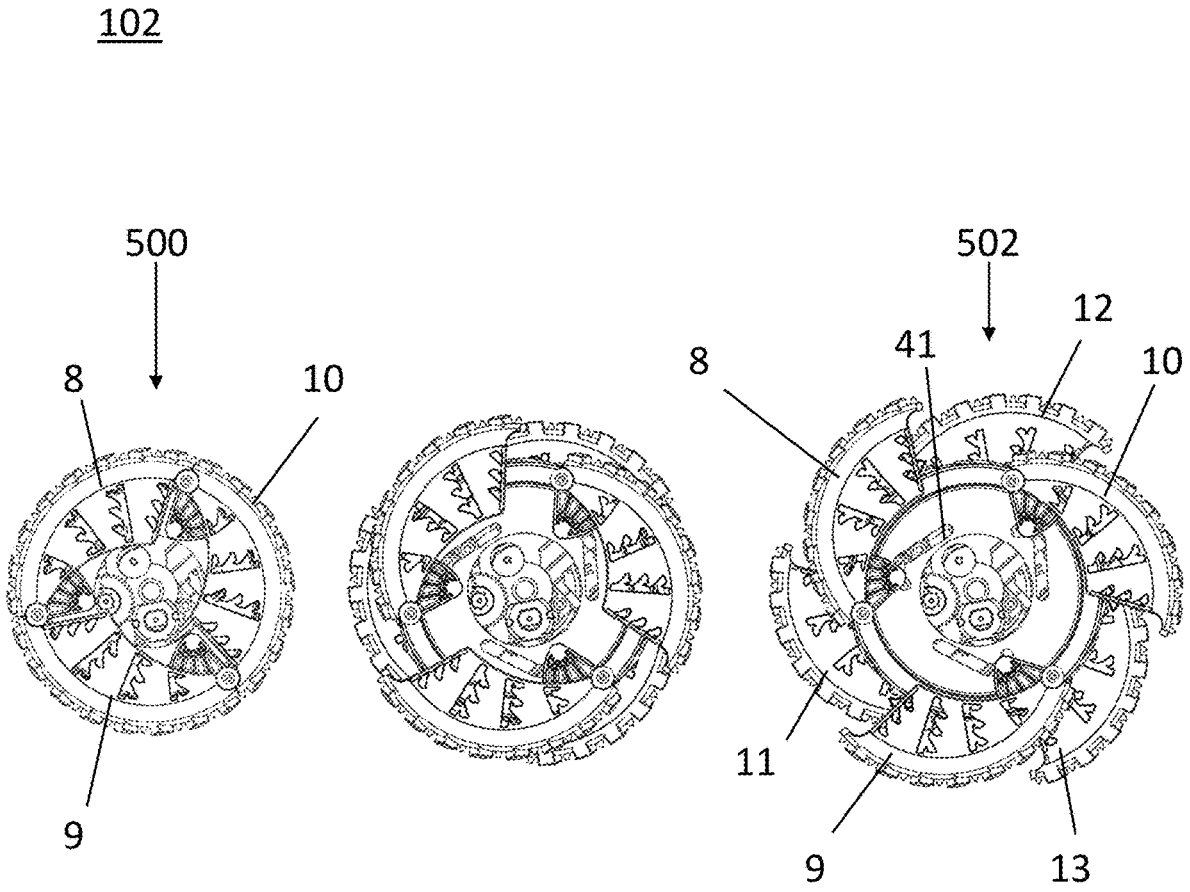
FIG. 5 is an interior-view illustration of a convertible wheel of the RC vehicle, depicting the convertible wheel as transitioning between the retracted and expanded states.

Finally, FIG. 5 provides a left-side, interior-view of the convertible wheel 102 transitioning between a retracted state 500 and an expanded state 502. As shown, rotation of the right blade slot (not shown) and left blade slot components 41 causes the blades (elements 8 through 13) to transition between the retracted 500 and expanded 502 states.

Figure 3C:
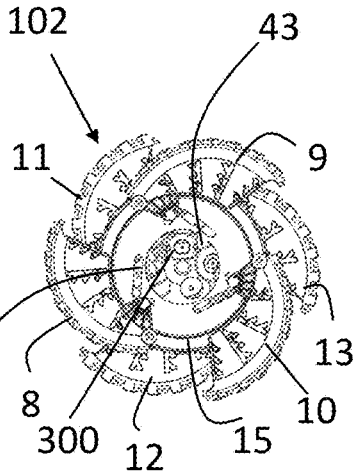
FIG. 3C is an interior-view of the convertible wheel in the expanded state, depicted from a left-side of the vehicle.

With respect to driving forces and referring to FIGS. 3B and 3C, the second motor 44 is connected with any suitable components to drive and rotate the convertible wheel 102 in the desired direction. As a non-limiting example, the second motor 44 is operably connected with the second gear box (element 43 in FIG. 8) to cause the second gear box to drive the vehicle. For example, the second gear box is engagingly connected (e.g., with teeth) with teeth on the interior of the wheel hub 7 or ring 40, or any other suitable component to cause the convertible wheel 102 to rotate in the desired direction. As understood by those skilled in the art, reversing the direction of the second motor 44 reverses rotation direction of the convertible wheel 102 and the driving direction of the RC vehicle.

Figure 6:
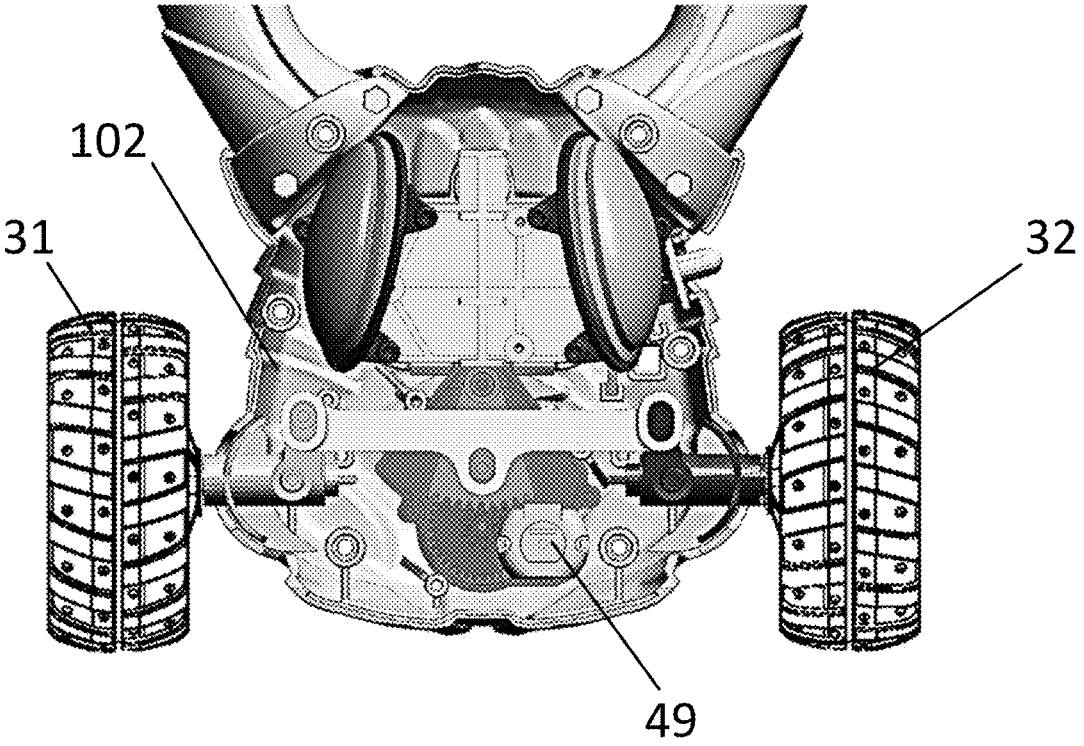
FIG. 6 is a top-view illustration of the RC vehicle, depicting an interior view of the RC vehicle and its steering mechanism.
Figure 7A:
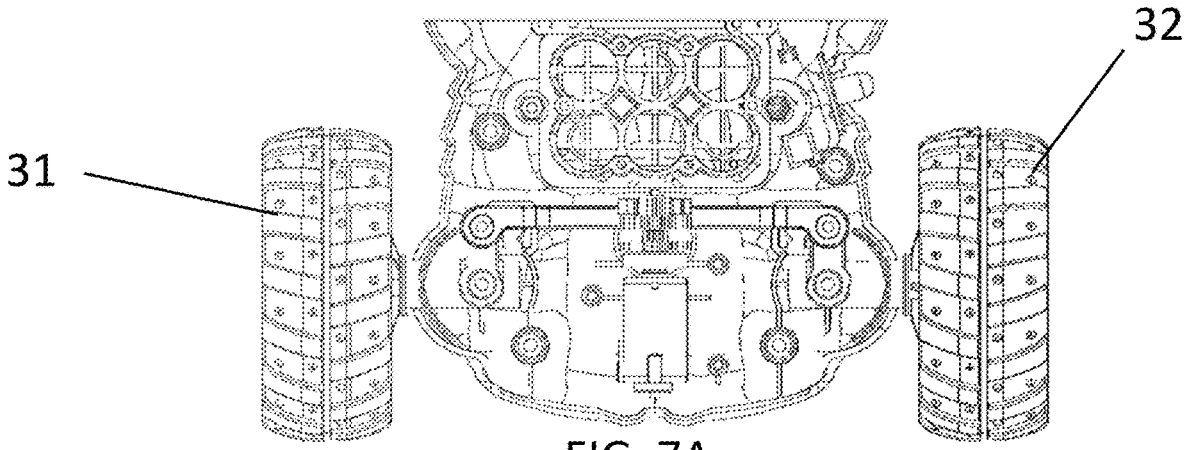
FIG. 7A is a top-view illustration of the RC vehicle, depicting an interior view of the RC vehicle and an alternate steering mechanism in a straight position.
Figure 7B:
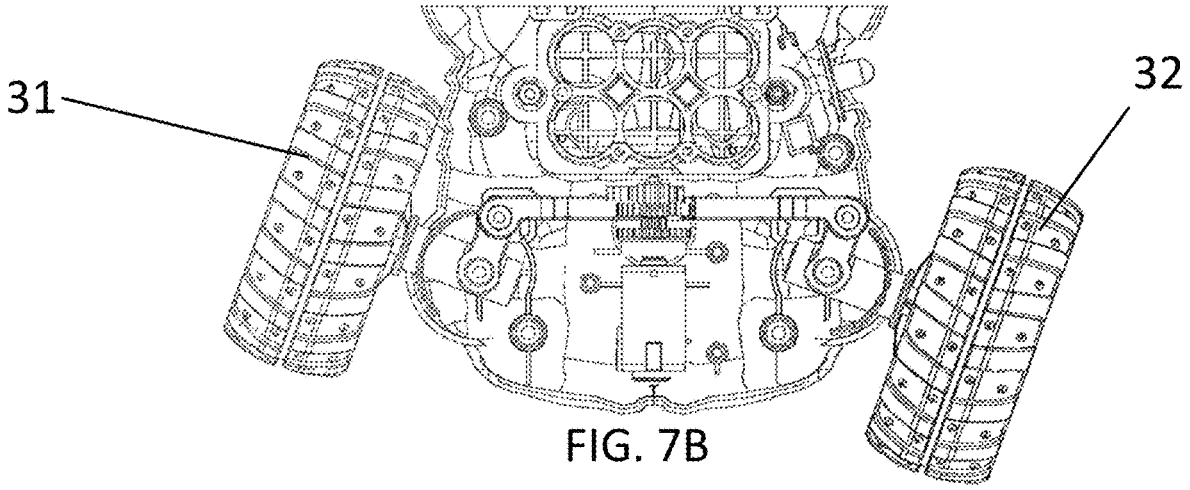
FIG. 7B is a top-view illustration of the RC vehicle, depicting an interior view of the RC vehicle and the alternate steering mechanism in a left-turn position.
Figure 7C:
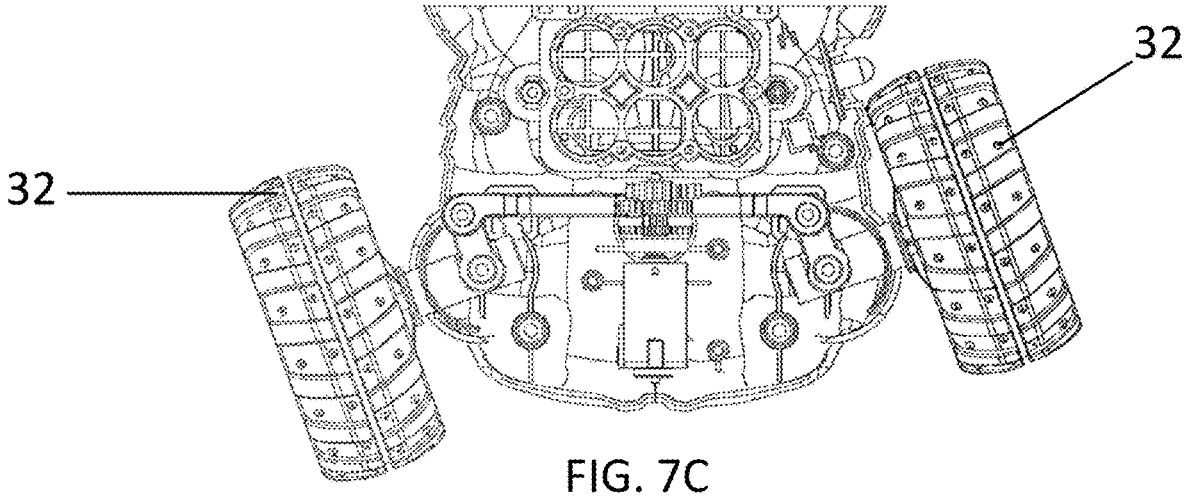
FIG. 7C is a top-view illustration of the RC vehicle, depicting an interior view of the RC vehicle and the alternate steering mechanism in a right-turn position.

The RC vehicle is formed to include any suitable mechanism or device to allow a user to selectively turn the RC vehicle. As a non-limiting example and as shown in FIG. 6, the third gear box 49 housing the third motor is operably connected with the left and right wheels 31 and 32 via a linkage. The wheels 31 and 32 are pivotally connected with the housing component 102 such that movement of the linkage causes the wheels 31 and 32 to turn left and right as desired. Another non-limiting example of such a linkage assembly is illustrated in FIGS. 7A through 7C. In this example and as shown, a third motor and corresponding gears are used to slide the linkage assembly left and right, which in turn causes the left and right wheels 31 and 32 to turn left and right as desired.

Figure 9:
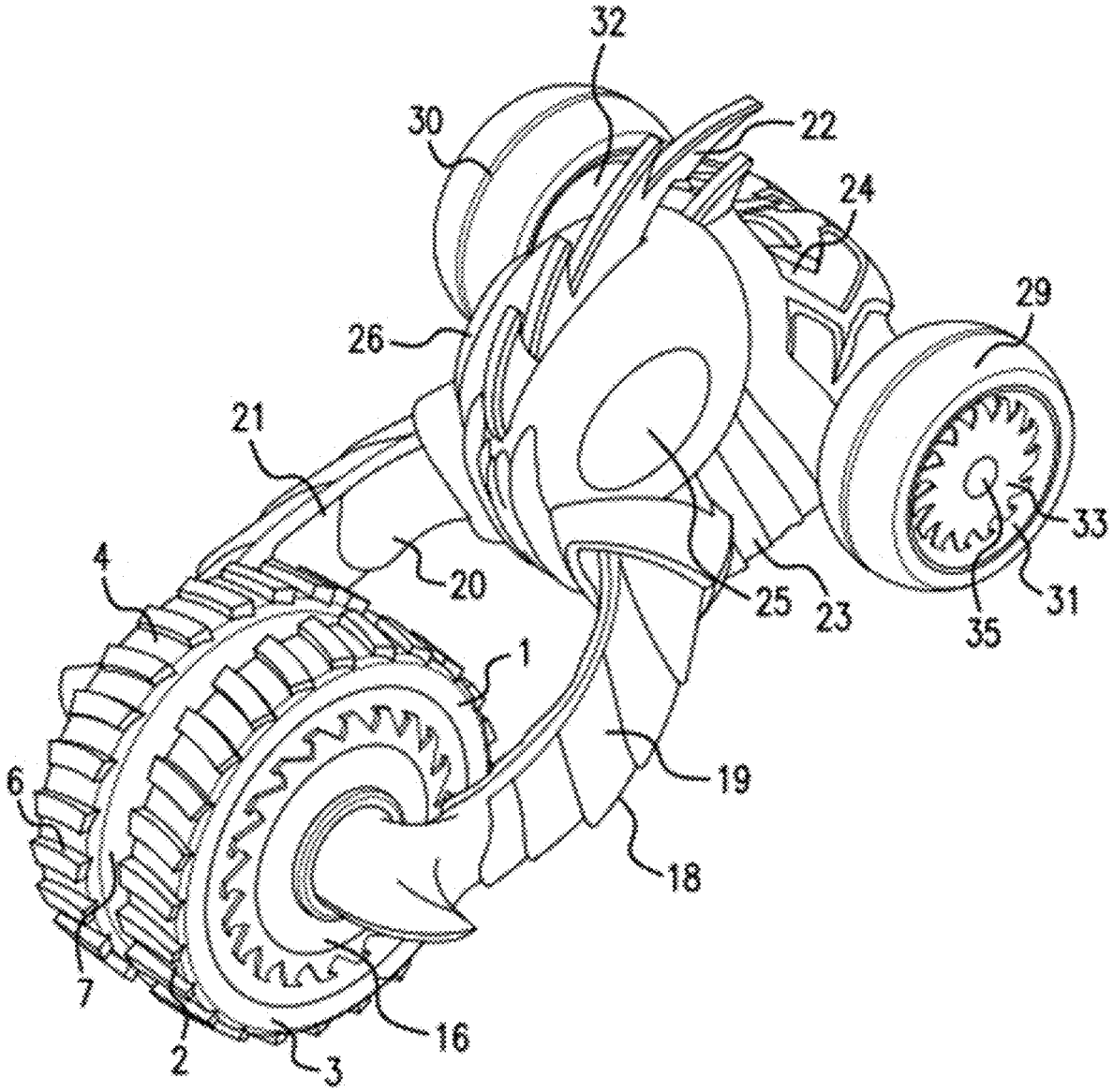
FIG. 9 is an assembled-view illustration of the RC vehicle.

As noted above, the RC vehicle of the present disclosure includes any parts as necessary to provide the operations as described herein. Provided in FIG. 9 is an exploded-view illustration of a non-limiting example of components that, when assembled, are operable for provided the described operations, with a corresponding assembled view depicted in FIG. 9. The parts as illustrated in FIG. 8 correspond to the following parts list.

| Label | Part |
|---|---|
| 1 | Rubber Front tire tread 1 |
| 2 | Rubber Front tire tread 2 |
| 3 | Rubber Front tire tread 3 |
| 4 | Rubber Front tire tread 4 |

-continued

| Label | Part |
|---|---|
| 5 | Rubber Front tire tread 5 |
| 6 | Rubber Front tire tread 6 |
| 7 | Wheel hub |
| 8 | Blade part 1 |
| 9 | Blade part 2 |
| 10 | Blade part 3 |
| 11 | Blade part 4 |
| 12 | Blade part 5 |
| 13 | Blade part 6 |
| 14 | Wheel cover 1 |
| 15 | Wheel cover 2 |
| 16 | Blade plate 1 |
| 17 | Blade plate 2 |
| 18 | Left arm lower |
| 19 | Left arm upper |
| 20 | Right arm lower |
| 21 | Right arm upper |
| 22 | Spikes |
| 23 | Housing lower |
| 24 | Housing upper |
| 25 | Left eye cover |
| 26 | Right eye cover |
| 27 | Left eye |
| 28 | Right eye |
| 29 | Left rear tire |
| 30 | Right rear tire |
| 31 | Left rear wheel |
| 32 | Right rear wheel |
| 33 | Left blade plate |
| 34 | Right blade plate |
| 35 | Left blade cover |
| 36 | Right blade cover |
| 37 | Holder 1 |
| 38 | Circle plate 1 |
| 39 | Right blade slot |
| 40 | Ring |
| 41 | Left blade slot |
| 42 | First Gear box |
| 43 | Second Gear box |
| 44 | Second Motor |
| 45 | Circle plate 2 |
| 46 | Holder 2 |
| 47 | Right post |
| 48 | Gear box A |
| 49 | Third Gear box |
| 50 | T bar |
| 51 | Left post |
| 52 | Gear A |
| 53 | Battery door |
| 54 | Battery plate |
| 55 | Partition A |
| 56 | Partition B |
| 57 | Gear B |
| 58 | Gear C |

-continued

| Label | Part |
|---|---|
| 59 | Gear D |
| 60 | Gear E |
| 61 | Gear F |
| 62 | Gear G |
| 63 | Gear 1 |
| 64 | Gear 2 |
| 65 | Gear 3 |
| 66 | Gear 4 |
| 67 | Gear 5 |
| 68 | Gear 6 |
| 69 | Gear 7 |
| 70 | Gear 8 |
| 71 | Gear 9 |
| 72 | Gear 10 |
| 73 | Gear 11 |

Figure 10:
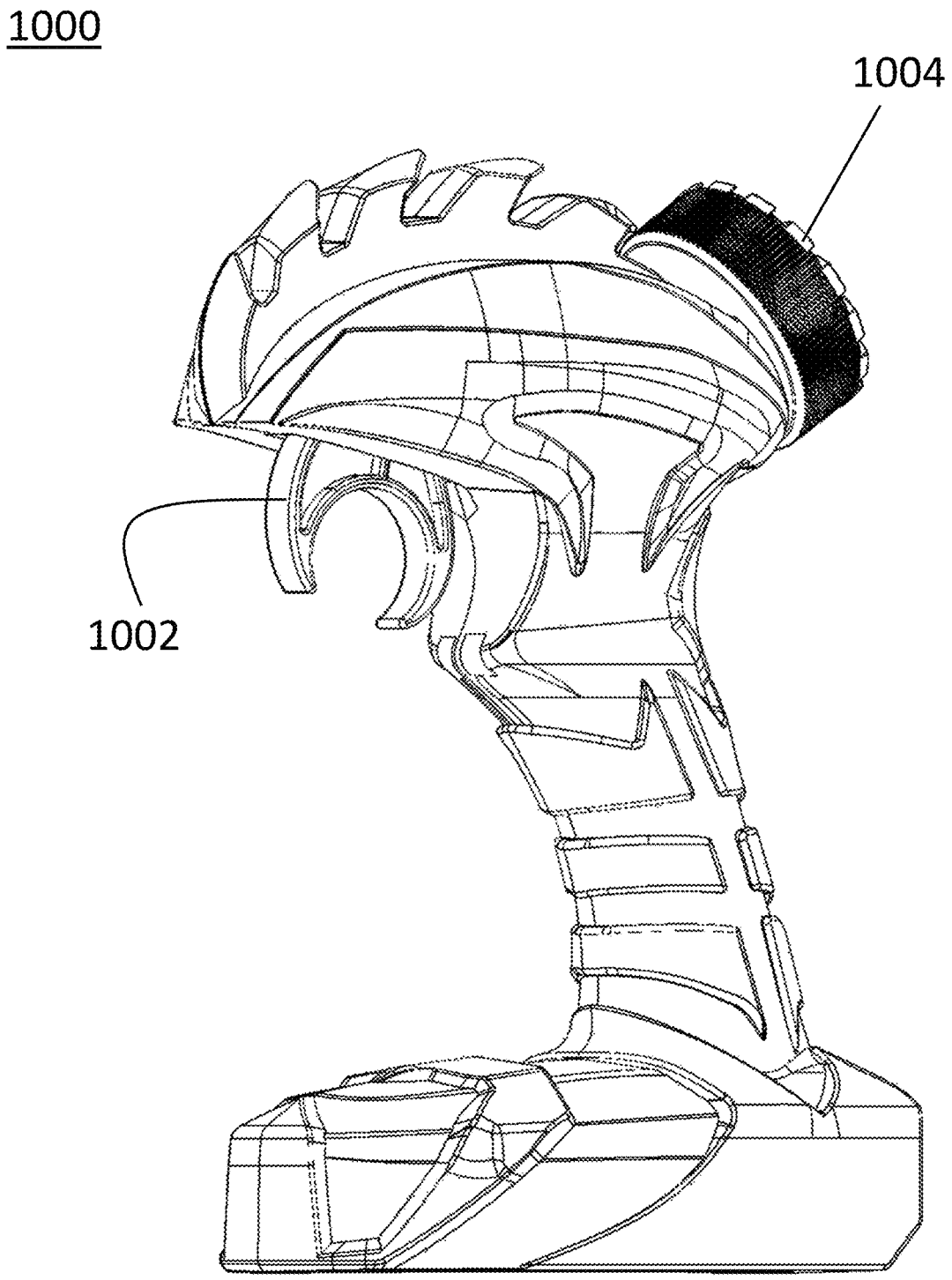
FIG. 10 is an illustration of an example remote control for controlling the RC vehicle.

Operation of the RC vehicle can be accomplished using any suitable mechanism, technique or device. For example and as shown in FIG. 10, a remote control (RC) controller 1000 is included that includes any components (e.g., integrated circuit, transmitter, battery, switches, etc.) as necessary to provide the relevant commands and operations to the RC vehicle. As non-limiting example, the RC controller 1000 includes a throttle trigger 1002. When the throttle trigger 1002 is pulled in, the RC controller 1000 sends a forward signal to the RC vehicle to cause the second motor to engage and force the RC vehicle forward. Pushing out the throttle trigger 1002 reverses the motion of the second motor to cause the RC vehicle to reverse. A rotatable and depressible steering wheel 1004 is also included. Rotation of the steering wheel 1004 activates the third motor to cause the wheels on the RC vehicle to turn left or right, depending on which way the steering wheel 104 is rotated. Finally, depressing the steering wheel 1004 sends a signal to the first motor to cause the first motor to activate the mechanical linkage to turn the left and right blade slots. For example, when the player press the steering wheel 1004 on the RC controller 1000 to send the signal, the vehicle will receive the signal to turn the first motor to rotate clockwise to turn the left and right blade slots. Then, all six blades will be pushed out via that mechanical linkage to open all six blades together. Alternatively, when the player press the button (i.e., the steering wheel 1004) on the RC controller 1000 again to send the signal, the RC vehicle will receive the signal to turn the motor to rotate counter-clockwise to turn the left and right blade slots. Then, all the six blades will be pulled in via that mechanical linkage to close all six blades together.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A remote control (RC) vehicle with a convertible wheel having expandable and retractable blades, comprising;

a housing component, the housing component having at least one arm extending therefrom and a pair of turning wheels operably connected thereto, the pair of turning wheels being operable for turning between left and right positions; and a convertible wheel rotatably connected to the at least one arm, the convertible wheel having a plurality of expandable and retractable blades movably attached with the convertible wheel at both a sliding connection point and a pivotal connection point, the convertible wheel being operable for driving the RC vehicle in a forward and reverse direction and causing the plurality of blades to selectively transition between a retracted state and an expanded state by slidably moving at the sliding connection point while rotating about the pivotal connection point;

wherein the convertible wheel includes a first motor housed within the convertible wheel, the first motor being operably connected with the plurality of blades to cause the blades to transition between the retracted and expanded states;

further comprising first and second wheel covers attached to the convertible wheel, and wherein the plurality of blades are pivotally connected to the first and second wheel covers to form the corresponding pivotal connection point; and further comprising left and right blade slot components housed within the convertible wheel and being operably connected between the first motor and the plurality of blades such that operation of the first motor causes the left and right blade slot components to rotate and force the plurality of blades to transition between the retracted and expanded states.

2. The RC vehicle as set forth in claim 1, wherein each of the left and right blade slot components have slots formed therethrough, and wherein each of the plurality of blades have a pin projecting therefrom, such that each pin passes through a slot of a corresponding left or right blade slot component to form the sliding connection point, whereby rotation of the left and right blade slot components causes the pin to slide within the corresponding slot at the sliding connection point, causing the blade to rotate about the pivotal connection point and transition between the retracted and expanded states.

3. The RC vehicle as set forth in claim 2, further comprising a second motor operably connected with the convertible wheel to drive the convertible wheel in a forward or reverse direction.

4. The RC vehicle as set forth in claim 3, further comprising a third motor positioned with the housing component and operably connected with the left and right wheels to cause the left and right wheels to turn between the left and right positions.

5. A remote control (RC) vehicle with a convertible wheel having expandable and retractable blades, comprising;

a housing component, the housing component having at least one arm extending therefrom and a pair of turning wheels operably connected thereto, the pair of turning wheels being operable for turning between left and right positions; and a convertible wheel rotatably connected to the at least one arm;

first and second wheel covers attached to the convertible wheel;

a plurality of blades, each of the plurality of blades being pivotally connected to one of the first and second wheel covers at a pivotal connection point, and wherein each of the plurality of blades has a pin projecting therefrom;

left and right blade slot components housed within the convertible wheel, each of the left and right blade slot components having one or more slots formed therethrough, such that the pin of each blade passes through a corresponding slot to form a sliding connection point;

a first motor housed within the convertible wheel and operably connected with the left and right blade slot components such that operation of the first motor causes the left and right blade slot components to rotate and, thereby, cause each blade to slide at the corresponding sliding connection point and rotate about the corresponding pivot connection point to rotate between retracted and expanded states; and a second motor operably connected with the convertible wheel to drive the convertible wheel in a forward or reverse direction, whereby the convertible wheel is operable for driving the RC vehicle in a forward and reverse direction and causing the plurality of blades to selectively transition between the retracted and expanded states.

* * * * *